US008973472B2

(12) United States Patent
Su

(10) Patent No.: US 8,973,472 B2
(45) Date of Patent: Mar. 10, 2015

(54) TOOL EXTENSION BAR

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 215 days.

(21) Appl. No.: 13/711,916

(22) Filed: Dec. 12, 2012

(65) Prior Publication Data

US 2013/0333528 A1 Dec. 19, 2013

(30) Foreign Application Priority Data

Jun. 14, 2012 (TW) ..... 101121347 A

(51) Int. Cl.
*B25B 23/00* (2006.01)

(52) U.S. Cl.
CPC ..... *B25B 23/0007* (2013.01)
USPC ..... 81/177.2; 81/177.85

(58) Field of Classification Search
CPC ..... B25B 23/0007; B25B 23/0035
USPC ..... 81/177.2, 177.85
See application file for complete search history.

(56) References Cited

U.S. PATENT DOCUMENTS

| | | | | | |
|---|---|---|---|---|---|
| 4,480,511 | A * | 11/1984 | Nickipuck | ..... | 81/124.6 |
| 4,537,100 | A * | 8/1985 | Palm | ..... | 81/177.85 |
| 4,589,308 | A * | 5/1986 | Palm | ..... | 81/177.85 |
| 6,170,365 | B1 * | 1/2001 | Zerver | ..... | 81/177.85 |
| 6,523,441 | B2 | 2/2003 | Lee | | |
| 6,736,034 | B1 * | 5/2004 | Gonzales | ..... | 81/177.85 |
| 6,823,762 | B2 | 11/2004 | Hu | | |
| 7,082,863 | B1 * | 8/2006 | Wang | ..... | 81/177.85 |
| 7,140,277 | B1 * | 11/2006 | Chern | ..... | 81/177.85 |
| 8,070,377 | B2 | 12/2011 | Wang | | |
| 8,424,423 | B2 * | 4/2013 | Su | ..... | 81/177.85 |
| 2004/0126182 | A1 * | 7/2004 | Lin | ..... | 403/322.2 |
| 2005/0145078 | A1 | 7/2005 | Chuan | | |
| 2008/0047403 | A1 * | 2/2008 | Lin | ..... | 81/177.85 |
| 2009/0226248 | A1 | 9/2009 | Wang | | |
| 2011/0056339 | A1 * | 3/2011 | Su | ..... | 81/177.85 |

FOREIGN PATENT DOCUMENTS

| | | | |
|---|---|---|---|
| CN | 2626682 | Y | 7/2004 |
| EP | 1457292 | A1 | 9/2004 |
| TW | 443188 | U | 6/2001 |
| TW | 574967 | U | 2/2004 |
| TW | M253449 | U | 12/2004 |
| TW | M268137 | U | 6/2005 |
| TW | M292450 | U | 6/2006 |

(Continued)

*Primary Examiner* — David B Thomas
(74) *Attorney, Agent, or Firm* — Alan D. Kamrath; Kamrath IP Lawfirm, P.A.

(57) ABSTRACT

A tool extension bar includes a rod including first and second ends. The second end is adapted to connect to and be driven by a power tool. A sleeve assembly is slidably mounted around the rod and includes an end adapted for connecting to a tool member. A radial hole extends in a radial direction at an end of the sleeve assembly. An elastic member is mounted around the second end of the rod and is biased against the rod and the sleeve assembly. An engaging member is movably received in the radial hole and is moveably engaged in the recess of the rod. The engaging member releasably engages the sleeve with the rod.

12 Claims, 8 Drawing Sheets

(56) References Cited

FOREIGN PATENT DOCUMENTS

| | | | |
|---|---|---|---|
| TW | M295563 | U | 8/2006 |
| TW | I296559 | B | 5/2008 |
| TW | M338139 | U | 8/2008 |
| TW | M395553 | U | 1/2011 |
| TW | M401509 | | 4/2011 |
| TW | M402178 | | 4/2011 |
| TW | 201121729 | A | 7/2011 |

* cited by examiner

TOOL EXTENSION BAR

BACKGROUND OF THE INVENTION

1. Field of the Invention

The present invention relates to a tool extension bar and, more particularly, to a tool extension bar suitable to have an application with a power tool and adapted to be connected to or disconnected from a tool member, such as a socket.

2. Description of the Related Art

U.S. Pat. No. 8,070,377 discloses a tool extension bar including a rod, a sleeve, a ball, and a spring. The rod has first and second sections. The first section of the rod includes an end for coupling with a pneumatic tool, and the second section of the rod extends from the other end of the first section. The sleeve is slideably mounted around the rod and includes an end for releasably coupling a bit. The sleeve includes an axial bore having larger and smaller sections. The larger section of the sleeve has polygonal cross sections corresponding to polygonal cross sections of the first section. A radial bore is formed in the sleeve and in communication with the smaller section. The ball is moveably received in the radial bore and moveably received in a recess of the second section of the rod to releasably engage the sleeve with the bit. The spring is mounted in the larger section of the axial bore of the sleeve and biases the sleeve from the retracted, second position to the extended, first position. The ball is engaged in the first contact section of the recess with an outermost portion of the ball projecting out of the radial bore of the sleeve when the sleeve is in the extended, first position, coupling the bit with the second end of the sleeve. The ball is engaged in the second contact section of the recess and does not project out of the radial bore of the sleeve when the sleeve is in the retracted, second position, allowing the bit to be disengaged from the second end of the sleeve.

However, the tool extension bar used with the pneumatic tool has some disadvantages. The pneumatic tool driven by a gas, usually compressed air supplied by a gas compressor, will certainly create vibration in operation. Thus, the spring is repeatedly retracted and extended to cause the sleeve to change from the first position to the second position. Therefore, the bit will disengage from the second end of the sleeve unintentionally.

Moreover, a user must grip on the end of the sleeve coupling to the bit and move the sleeve to cause the sleeve to move relative to the rod in the axial direction from the first position to the second position to allow the bit to be disengaged from the end of the sleeve. If the total length of the tool extension bar is very long, the user can not use it comfortably and can not grip the tool extension bar efficiently. In other words, it is not ergonomic.

The present invention is, therefore, intended to obviate or at least alleviate the problems encountered in the prior art.

SUMMARY OF THE INVENTION

The present invention solves this need and other problems in the field of extension bars by providing a tool extension bar including a rod, a sleeve assembly, an elastic member, and an engaging member. The rod includes first and second ends spaced in an axial direction. A recess is formed adjacent to the first end of the rod and includes a first contact section arranged adjacent to the first end of the rod and a second contact section extending toward the second end of the rod from an end of the first contact section. The second end of the rod is adapted to connect to and be driven by a power tool. The sleeve assembly is mounted around the rod and slideable relative to the rod in the axial direction between first and second positions. A radial hole extends in a radial direction perpendicular to the axial direction at an end of the sleeve assembly and aligns with the recess of the rod body. The elastic member is mounted around the second end of the rod and is biased against the rod and the sleeve assembly. The engaging member is movably received in the radial hole of the sleeve assembly in the radial direction and is moveably engaged in the recess of the rod in the axial and radial directions. The engaging member releasably engages the sleeve assembly with the rod.

When the sleeve assembly is moved to the first position, the engaging member is pushed by the radial hole of the sleeve assembly and engaged in the first contact section of the recess, with an outermost portion of the engaging member projecting out of the radial hole of the sleeve assembly and engaging with a tool member.

When the sleeve assembly is moved to the second position, the engaging member is engaged in the second contact section of the recess, with the outermost portion of the engaging member not projecting out of the radial hole of the sleeve assembly and disengaging from the tool member.

Preferably, the sleeve assembly includes a gripping member and a sleeve member mounted on an end of the gripping member.

The elastic member is a spring.

The engaging member is a ball.

An advantage of the tool extension bar according to the present invention is that one hand of the user can grip the first end of the gripping member and that another hand of the user can control the power tool. The user can control the sleeve assembly moved between the first and second positions at the first end of the gripping member spaced away the second end of the gripping member and the sleeve member connecting to the tool member.

Another advantage of the tool extension bar according to the present invention is that when the sleeve assembly is moved to the first position, the engaging member is engaged in the first contact section of the recess with the outermost portion of the engaging member projecting out of the radial hole of the sleeve member, engaging the tool member with the first end of the sleeve member. On the other hand, when the sleeve assembly is moved to the second position, the engaging member is engaged in the second contact section of the recess and does not project out of the radial hole of the sleeve member, allowing the tool member to be disengaged from the first end of the sleeve member.

A further advantage of the tool extension bar according to the present invention is that the two opposite ends of the elastic member are respectively compressed against the first contact surface of the convex portion of the rod and the second contact surface of the gripping member of the sleeve assembly. Thus, when the user does not grip the gripping member, the two opposite ends of the elastic member are respectively extended against the first contact surface of the convex portion of the rod and the second contact surface of the gripping member of the sleeve assembly to cause the sleeve assembly to move from the second position to the first position without strain.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
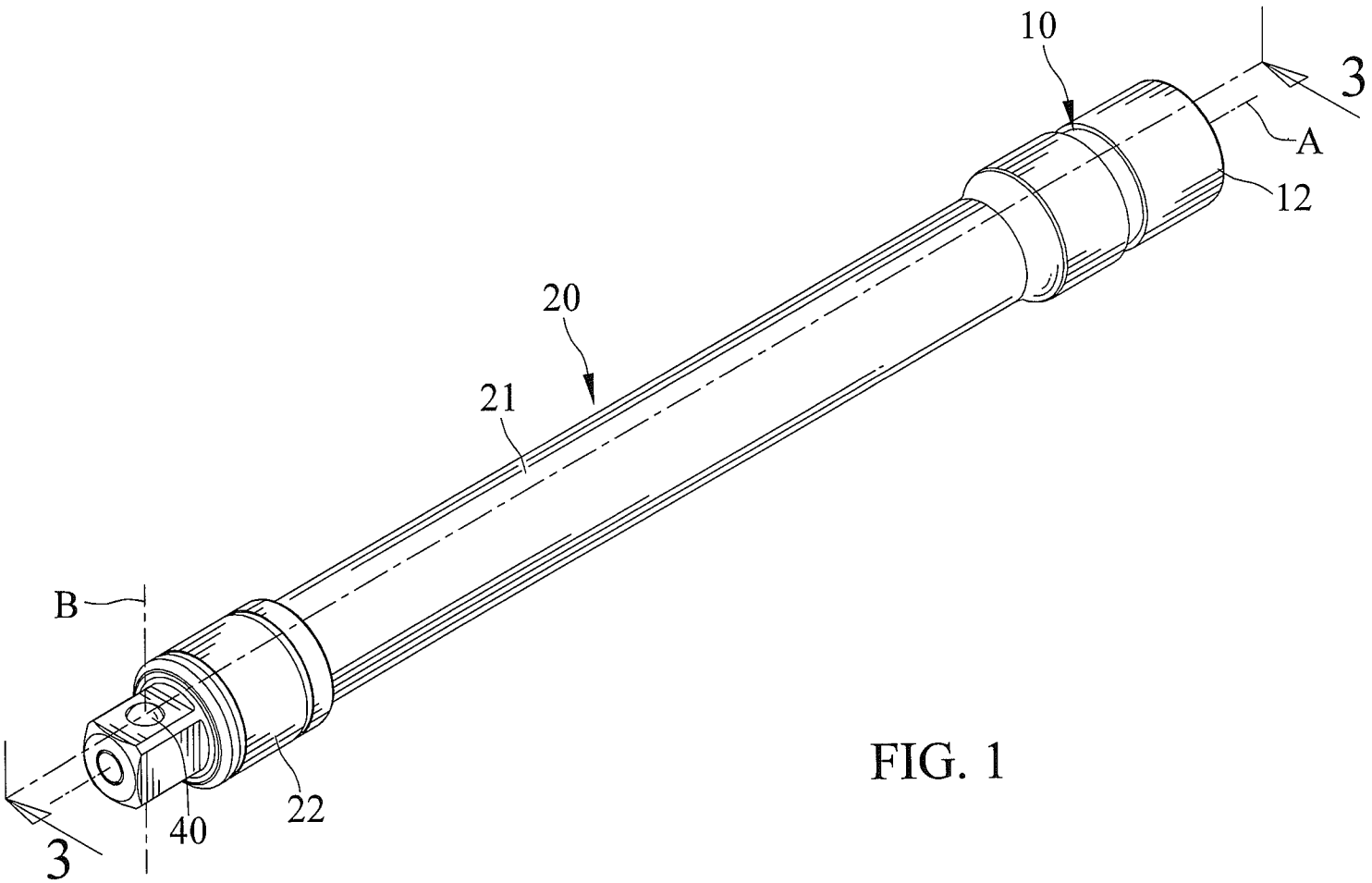
FIG. 1 shows a perspective view of a tool extension bar of a first embodiment according to the present invention.
Figure 2:
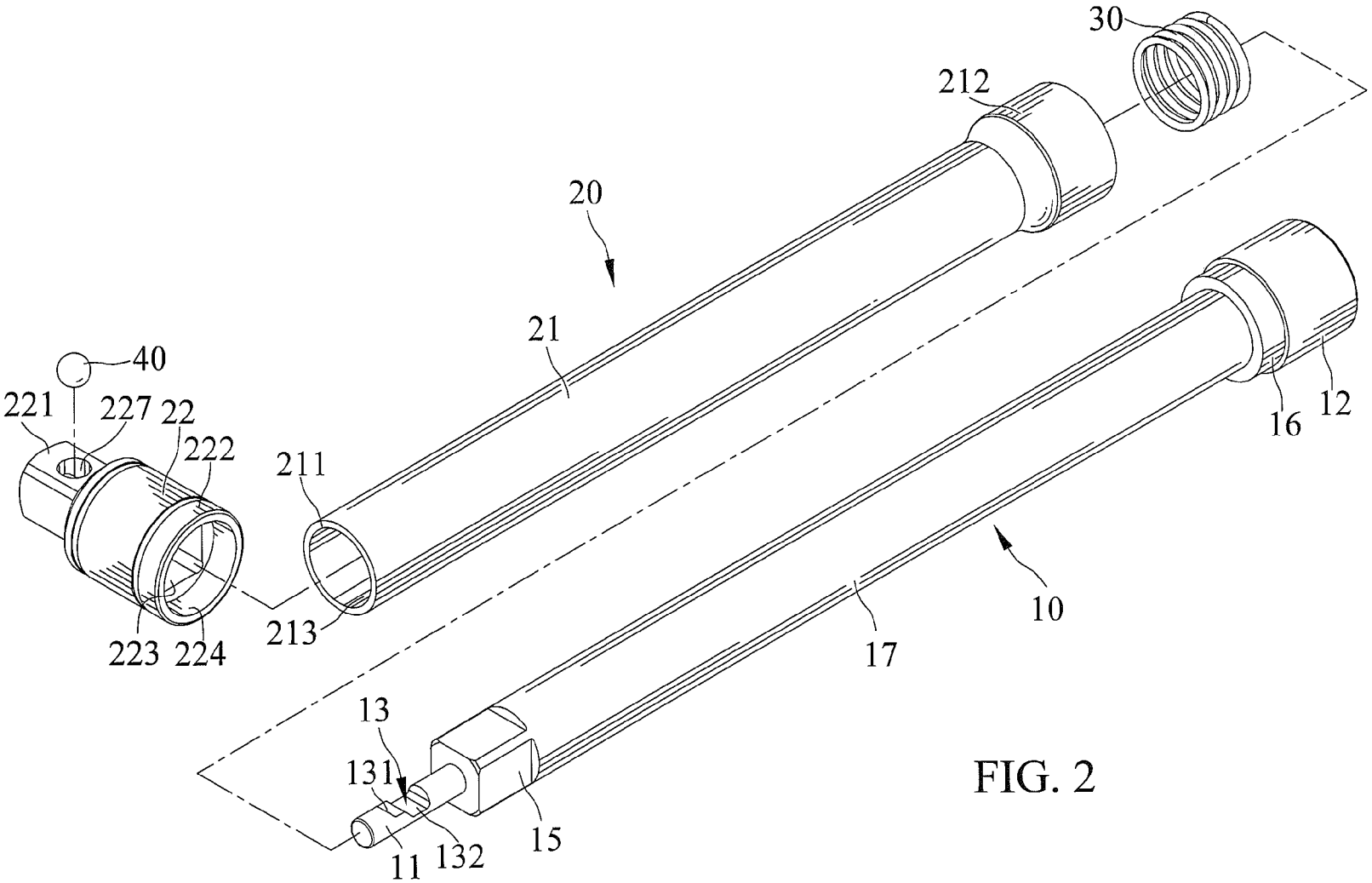
FIG. 2 shows an exploded, perspective view of the tool extension bar of FIG. 1.
Figure 3:
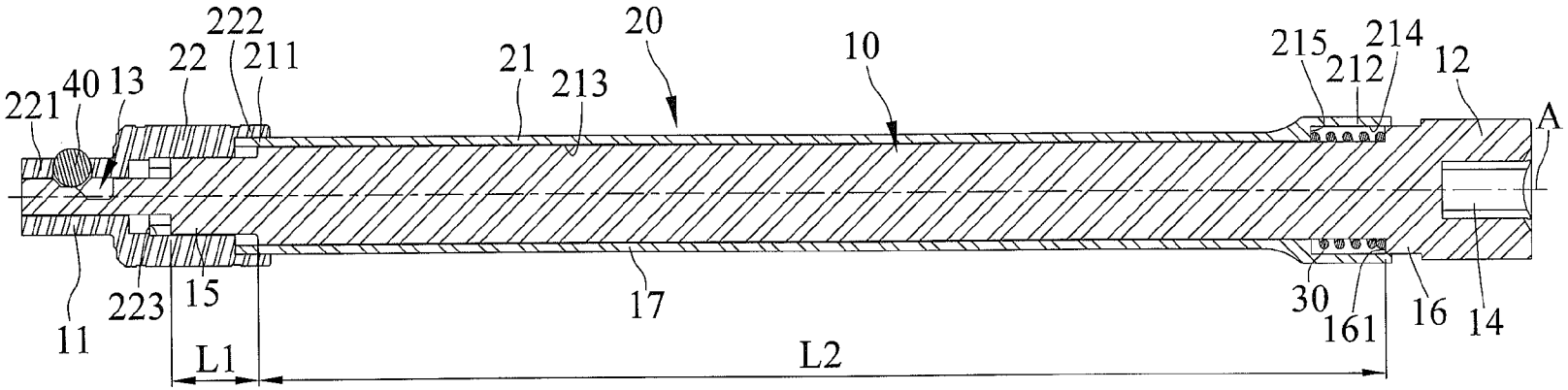
FIG. 3 shows a cross-section view taken along line 3-3 of FIG. 1.
Figure 4:
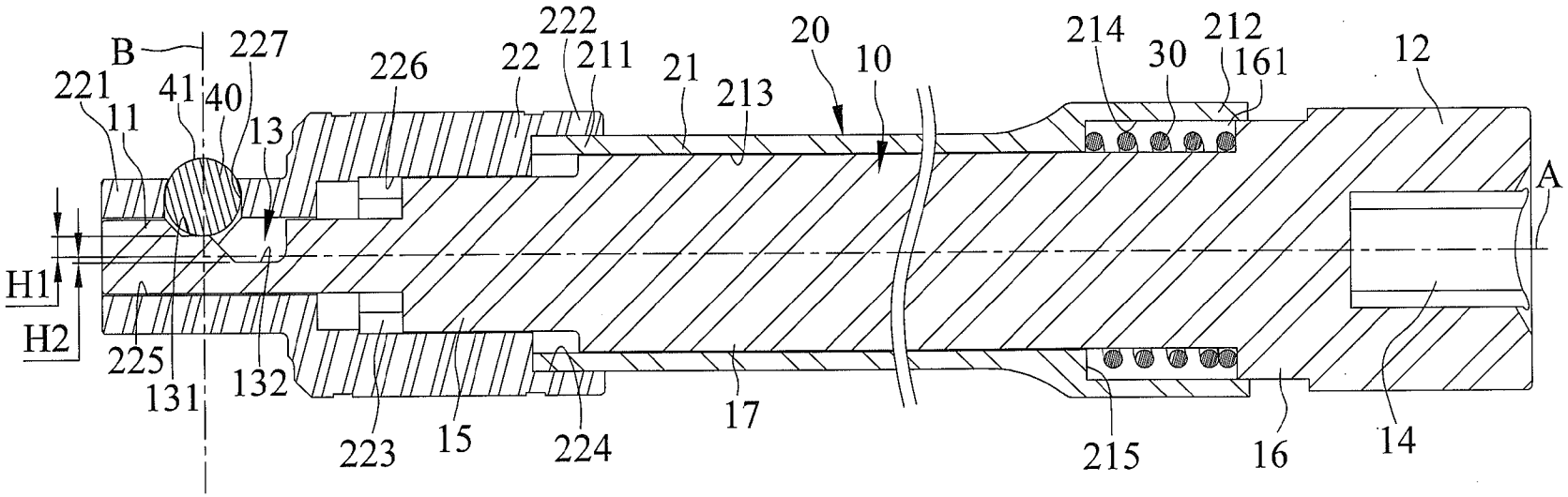
FIG. 4 shows a partial, enlarged view of FIG. 3, and illustrates a sleeve assembly located at a first position.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "end", "portion", "longitudinal", "radial", "diameter", "width", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE PREFERRED EMBODIMENTS

FIGS. 1 through 5 show a first embodiment of a tool extension bar according to the present invention shown in the drawings. The tool extension bar includes a rod 10, a sleeve assembly 20 slidably mounted around the rod 10, an elastic member 30 mounted on the rod 10, and an engaging member 40.

The rod 10 includes a first end 11, a second end 12 spaced from the first end 11 along a first axis A, and a recess 13 formed adjacent to the first end 11. The first and second ends 11 and 12 of the rod 10 respectively have a circular cross section. The recess 13 has a first contact section 131 arranged adjacent to the first end 11 of the rod 10, and a second contact section 132 extending toward the second end 12 of the rod 10 from an end of the first contact section 131 opposite to the first end 11 of the rod 10. A first height H1 defined from the first contact section 131 to the first axis A in a radial direction perpendicular to the first axis A is greater than a second height H2 defined from the second contact section 132 to the first axis A in the radial direction. Namely, the first contact section 131 having a depth in the radial direction perpendicular to the first axis A is less than that of the second contact section 132. An engaging groove 14 is formed at an end face of the second end 12 of the rod 10 and adapted to connect to and be driven by a power tool, such as a pneumatic tool, an electric tool, or an automated machine. The rod 10 further includes a shoulder portion 15 disposed adjacent to the first end 11 thereof, a convex portion 16 disposed adjacent to the second end 12 thereof, and a body portion 17 formed between the shoulder and convex portions 15 and 16 along the first axis A. Two opposite ends of the shoulder portion 15 along the first axis A is defined with a first length L1. The shoulder portion 15 has a rectangular cross section perpendicular to the first axis A, and includes a width extended perpendicular to first axis A greater than an outer diameter of the first end 11 of the rod 10. The convex portion 16 and the body portion 17 have circular cross sections perpendicular to the first axis A. The convex portion 16 includes an outer diameter less than an outer diameter of the second end 12 of the rod 10. Moreover, the outer diameter of the convex portion 16 is greater than the width of the shoulder portion 15 and an outer diameter of the body portion 17. The convex portion 16 includes a first contact surface 161 formed adjacent and connected to the body portion 17. Two opposite ends of the body portion 17 along the first axis A is defined with a second length L2 being at least three times as great as the first length L1.

The sleeve assembly 20 is mounted circumferentially outside the rod 10 and is slideable relative to rod 10 along the first axis A. The sleeve assembly 20 includes a gripping member 21 and a sleeve member 22 mounted on an end of the gripping member 21. The gripping member 21 is generally cylindrical shaped and includes a first end 211 connected with the sleeve member 22 and a second end 212 spaced from the first end 211 of the gripping member 21 along the first axis A. An outer diameter of the first end 211 of the gripping member 21 is less than that of the second end 212 of the gripping member 21. The gripping member 21 further includes a through hole 213 extending from the first end 211 of the gripping member 21 to the second end 212 of the gripping member 21 to receive the body portion 17 of the rod 10, so that the gripping member 21 completely covers the body portion 17 of the rod 10. The through hole 213 includes an expanded section 214 formed adjacent to the second end 212 of the gripping member 21 along the first axis A. A second contact surface 215 is formed between an inner periphery of the through hole 213 and an inner periphery of the expanded section 214. Thus, the elastic member 30 is received in the expanded section 214 of the gripping member 21. The sleeve member 22 includes a first end 221 adapted for connecting to a tool member, such as a socket, a second end 222 spaced from the first end 221 along the first axis A and connected to the first end 211 of the gripping member 21, and a coupling hole 223 extending between the first and second ends 221 and 222 thereof to mount around the first end 11 of the rod 10. The coupling hole 223 of the sleeve member 22 is connected and in communication with the through hole 213 of the gripping member 21. The coupling hole 223 includes a larger section 224, a smaller section 225, and a middle section 226 arranged between the larger and smaller sections 224 and 225 along the first axis A. The larger section 224 has a circular cross section perpendicular to the first axis A and corresponding to the circular cross section of the body portion 17 of the rod 10. The smaller section 225 has a circular cross section perpendicular to the first axis A and corresponding to the circular cross section of the first end 11 of the rod 10. The middle section 226 has a rectangular cross section perpendicular to the first axis A and corresponding to the rectangular cross section of the shoulder portion 15 of the rod 10 to increase the joint strength between the rod 10 and the sleeve assembly 20 to cause the rod 10 to be adapted to connect to and be driven by a high torque power tool. Moreover, the sleeve member 22 further includes a radial hole 227 extending along a second axis B perpendicular to the first axis A from an outer periphery of the first end 221 of the sleeve member 22 through an inner periphery of the smaller section 225 of the coupling hole 223. The radial hole 227 aligns with the recess 13 of the rod 10. In a preferred form, the first end 221 of the sleeve member 22 has a rectangular cross section perpendicular to the first axis A, and the second end 222 of the sleeve member 22 has a circular cross section perpendicular to the first axis A.

The elastic member 30 is mounted around the body portion 17 of the rod 10 and is received in the expanded section 214 of the gripping member 21. In a preferred form, the elastic element 30 is a spring. Two opposite ends of the elastic member 30 respectively abut and are biased against the first contact surface 161 of the convex portion 16 of the rod 10 and the second contact surface 215 of the gripping member 21 of the sleeve assembly 20.

The engaging member 40 is movably received in the radial hole 227 of the sleeve member 22 of the sleeve assembly 20 along the second axis B. Moreover, the engaging member 40 is also moveably engaged in the first and second contact sections 131 and 132 of the recess 13 of the rod 10 along the first and second axes A and B to releasably engage the sleeve assembly 20 with the rod 10. In a preferred form, the engaging member 40 is a ball. A distal end of the radial hole 227 of the sleeve member 22 adjacent to the outer periphery of the first end 221 of the sleeve member 22 having an inner diameter is less than an outer diameter of the engaging member 40 to avoid the engaging member 40 disengaging from the radial hole 227 of the sleeve member 22, such that a outermost portion 41 of the engaging member 40 selectively projects out of the radial hole 227 of the sleeve member 22 to engage the sleeve assembly 20 with the tool member.

Figure 5:
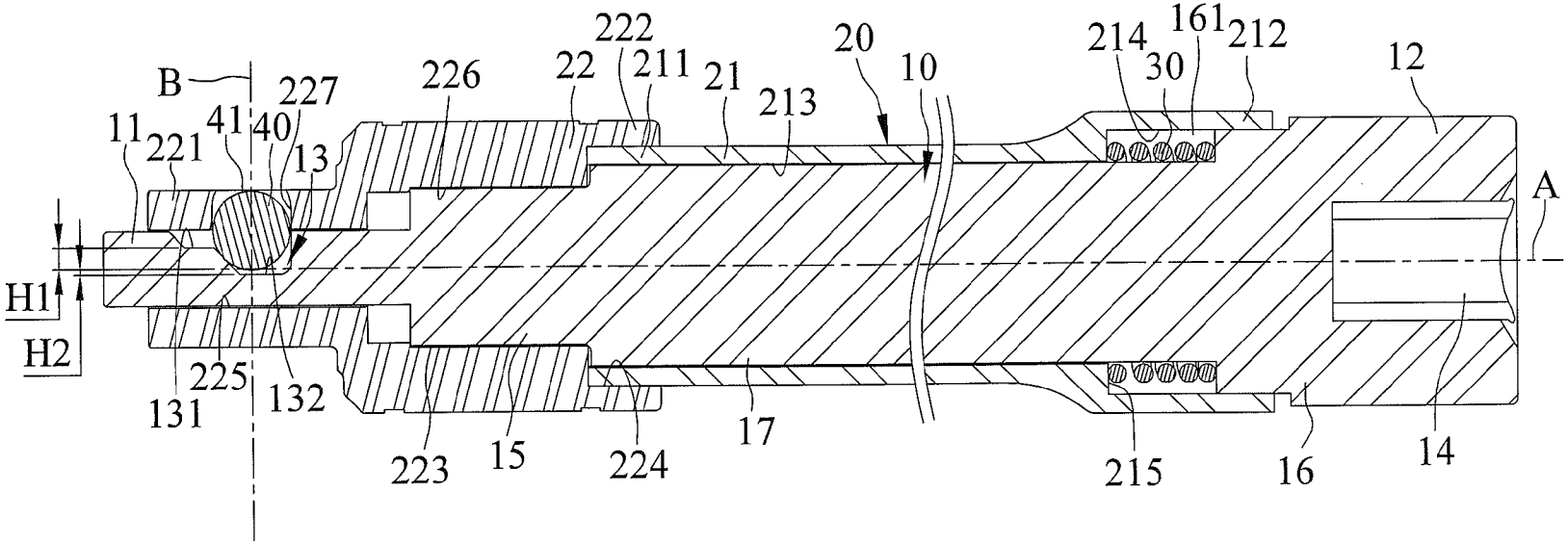
FIG. 5 shows a continued, cross-section view of FIG. 4, and illustrates the sleeve assembly located at a second position.

The sleeve assembly 20 is moveable relative to rod 10 along the first axis A between a first position (shown in FIG. 4) and a second position (shown in FIG. 5). The elastic element 30 is compressed when the sleeve assembly 20 is in the second position. When the sleeve assembly 20 is moved to the first position, the engaging member 40 is pushed by the radial hole 227 of the sleeve member 22 and is engaged in the first contact section 131 of the recess 13. As mentioned above, the first contact section 131 has the depth in the radial direction perpendicular to the first axis A less than that of the second contact section 132. Thus, when the engaging member 40 is seated in the first contact section 131, the outermost portion 41 of the engaging member 40 projects out of the radial hole 227 of the sleeve member 22 and engages with the tool member. Therefore, the tool member is securely locked on the tool extension bar and can be driven when the rod 10 of the tool extension bar secured to the power tool rotates.

Referring to FIG. 5, when a user grips the gripping member 21 and moves it along the first axis A to cause the sleeve assembly 20 to move to the second position, the engaging member 40 is pushed by the radial hole 227 of the sleeve assembly 20 and is moved along the second axis B to engage in the second contact section 132 of the recess 13. As mentioned above, the outermost portion 41 of the engaging member 40 does not project out of the radial hole 227 of the sleeve assembly 20 and disengages from the tool member. Therefore, the tool member is quickly unlocked on the tool extension bar. The two opposite ends of the elastic member 30 are respectively compressed against the first contact surface 161 of the convex portion 16 of the rod 10 and the second contact surface 215 of the gripping member 21 of the sleeve assembly 20. Thus, when the user does not grip the gripping member 21, the two opposite ends of the elastic member 30 respectively extend against the first contact surface 161 of the convex portion 16 of the rod 10 and the second contact surface 215 of the gripping member 21 of the sleeve assembly 20 to cause the sleeve assembly 20 to move from the second position to the first position without strain.

Figure 6:
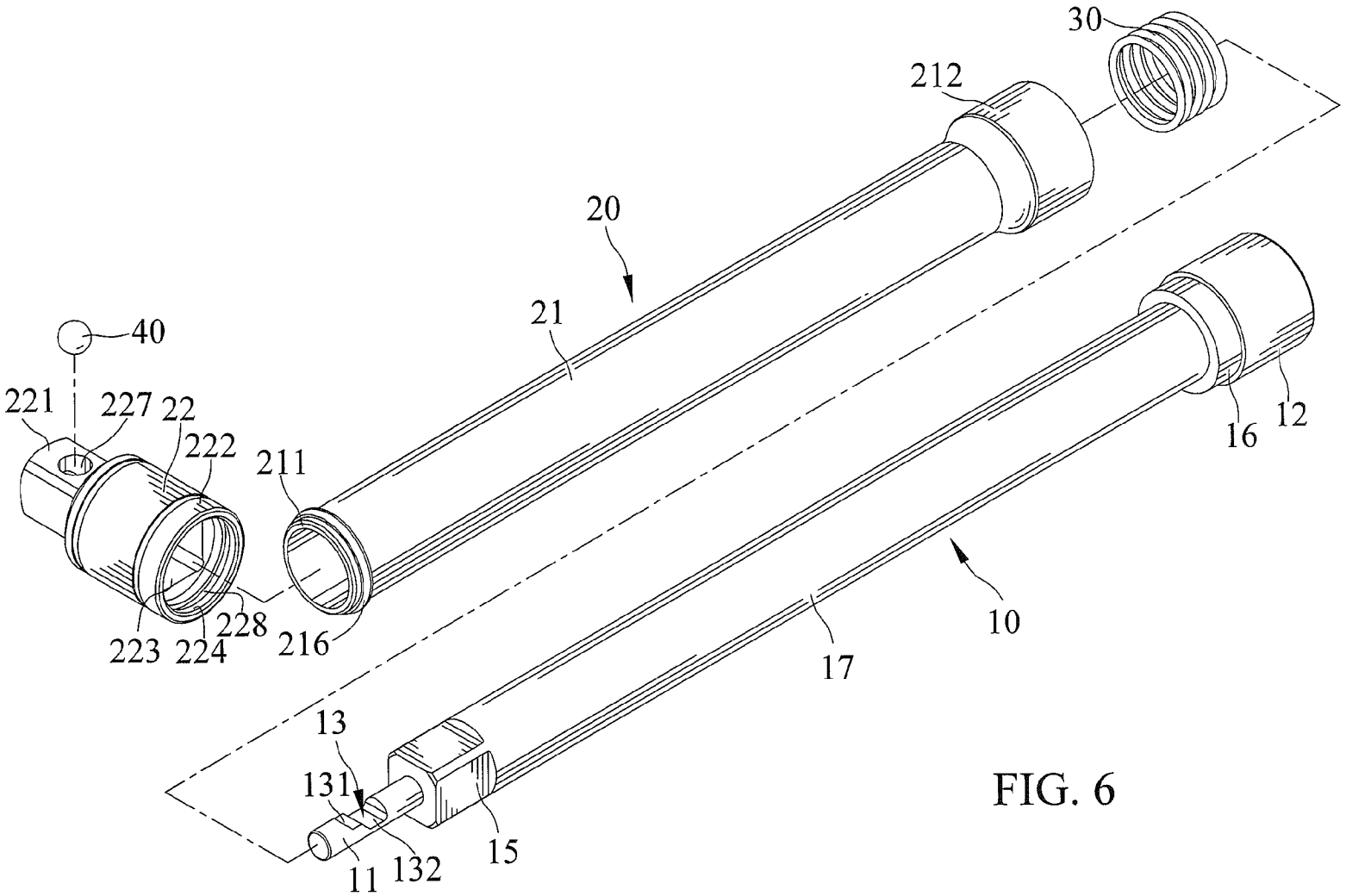
FIG. 6 shows an exploded, perspective view of a tool extension bar of a second embodiment according to the present invention.
Figure 7:
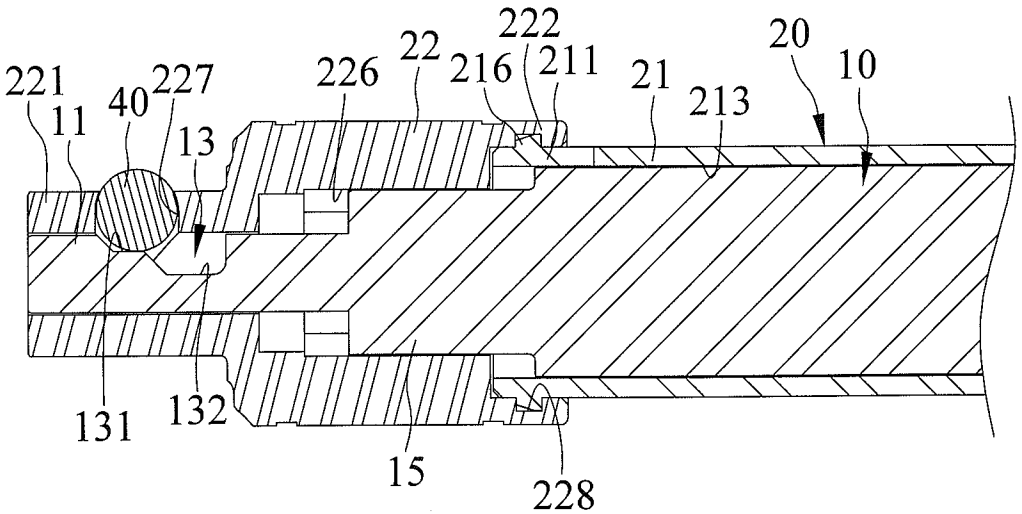
FIG. 7 shows a partial, enlarged cross-section view of FIG. 6.

FIGS. 6 and 7 show a second embodiment of the tool extension bar according to the present invention shown in the drawings. Specifically, an annular engaging portion 216 is formed at the first end 211 of the gripping member 21, and extends along the first axis A toward the second end 222 of the sleeve member 22. An annular engaging recess 228 is formed at the second end 222 of the sleeve member 22 and is engaged with the engaging portion 216 of the gripping member 21 to cause the gripping member 21 and the sleeve member 22 to rotatable connect with each other.

Figure 8:
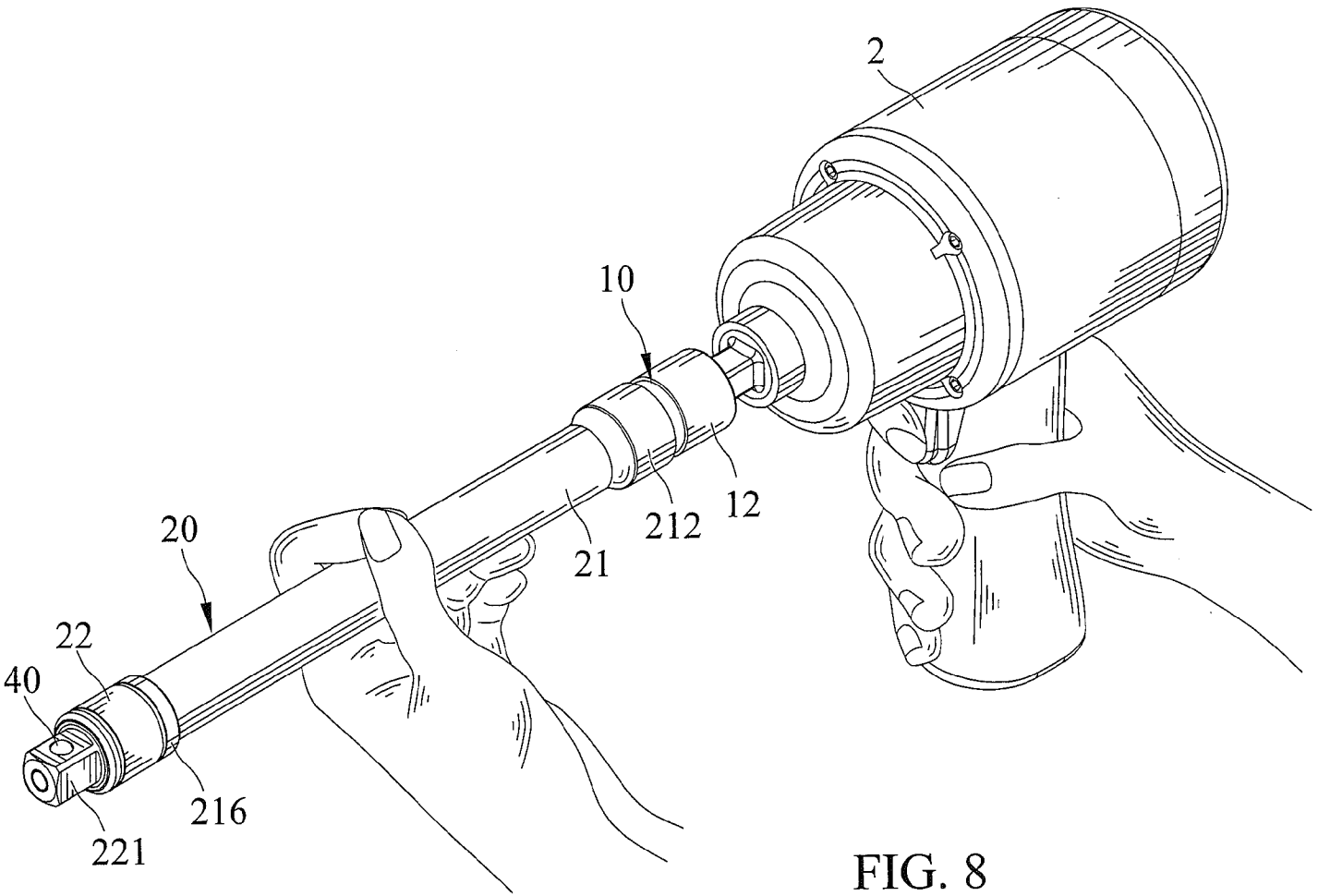
FIG. 8 shows a perspective view of a tool extension bar according to the present invention, and illustrates the tool extension bar connected to a pneumatic tool.

FIG. 8 shows the second end 12 of the rod 10 connected to a pneumatic tool 2. Therefore, one hand of the user can grip the first end 211 of the gripping member 21, and another hand of the user can control the pneumatic tool 2. Thus, the user can move the gripping member 21 to cause the sleeve assembly 20 to move between the first and second positions. Namely, the user can control the sleeve assembly 20 to move between the first and second positions at the first end 211 of the gripping member 21 spaced away the second end 212 of the gripping member 21 and the sleeve member 22 connecting to the tool member.

The tool extension bar includes the following advantages:

1. One hand of the user can grip the first end 211 of the gripping member 21 and another hand of the user can control the pneumatic tool 2. The user can control the sleeve assembly 20 to move between the first and second positions at the first end 211 of the gripping member 21 spaced away the second end 212 of the gripping member 21 and the sleeve member 22 connecting to the tool member.

2. When the sleeve assembly 20 is moved to the first position, the engaging member 40 is engaged in the first contact section 131 of the recess 13 with the outermost portion 41 of the engaging member 40 projecting out of the radial hole 227 of the sleeve member 22, engaging the tool member with the first end 221 of the sleeve member 22. On the other hand, when the sleeve assembly 20 is moved to the second position, the engaging member 40 is engaged in the second contact section 132 of the recess 13 and does not project out of the radial hole 227 of the sleeve member 22, allowing the tool member to be disengaged from the first end 221 of the sleeve member 22.

3. The two opposite ends of the elastic member 30 are respectively compressed against the first contact surface 161 of the convex portion 16 of the rod 10 and the second contact surface 215 of the gripping member 21 of the sleeve assembly 20. Thus, when the user does not grip the gripping member 21, the two opposite ends of the elastic member 30 respectively extend against the first contact surface 161 of the convex portion 16 of the rod 10 and the second contact surface 215 of the gripping member 21 of the sleeve assembly 20 to cause the sleeve assembly 20 to move from the second position to the first position without strain.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

What is claimed is:

1. A tool extension bar comprising:

a rod including first and second ends spaced in an axial direction, with a recess formed adjacent to the first end of the rod and including a first contact section arranged adjacent to the first end of the rod and a second contact section extending toward the second end of the rod from an end of the first contact section, with the second end of the rod adapted to connect to and be driven by a power tool, wherein the second end of the rod is spaced from the first end rod along an axis, with a first height defined from the first contact section to the axis in the radial direction perpendicular to the axis greater than a second height defined from the second contact section to the axis in the radial direction perpendicular to the axis, wherein the rod further includes a shoulder portion disposed adjacent to the first end of the rod, a convex portion disposed adjacent to the second end of the rod, and a body portion formed between the shoulder and the convex portion along the axis, with the convex portion including a first contact surface formed adjacent and connected to the body portion;

a sleeve assembly mounted around the rod and slideable relative to the rod in the axial direction between first and second positions, with a radial hole extending in a radial direction perpendicular to the axial direction at an end of the sleeve assembly and aligning with the recess of the rod body;

an elastic member mounted around the second end of the rod and biased against the rod and the sleeve assembly; and an engaging member movably received in the radial hole of the sleeve assembly in the radial direction and moveably engaged in the recess of the rod in the axial and radial directions, with the engaging member releasably engaging the sleeve assembly with the rod;

wherein when the sleeve assembly is moved to the first position, the engaging member is pushed by the radial hole of the sleeve assembly and engaged in the first contact section of the recess, with an outermost portion of the engaging member projecting out of the radial hole of the sleeve assembly and engaging with a tool member; and wherein when the sleeve assembly is moved to the second position, the engaging member is engaged in the second contact section of the recess, with the outermost portion of the engaging member not projecting out of the radial hole of the sleeve assembly and disengaging from the tool member.

2. The tool extension bar as claimed in claim 1, wherein the first contact section has a depth in the radial direction perpendicular to the axis less than that of the second contact section, wherein when the engaging member is seated in the first contact section, the outermost portion of the engaging member projects out of the radial hole of the sleeve assembly, and wherein when the engaging member is seated in the second contact section, the outermost portion of the engaging member does not project out of the radial hole of the sleeve assembly.

3. The tool extension bar as claimed in claim 1, wherein the sleeve assembly includes a gripping member and a sleeve member, with the gripping member including a first end connected with the sleeve member and a second end spaced from the first end of the gripping member along the axis, with the gripping member further including a through hole extending from the first end of the gripping member to the second end of the gripping member to receive the body portion of the rod, with the through hole including an expanded section formed adjacent to the second end of the gripping member along the axis, with a second contact surface formed between an inner periphery of the through hole and an inner periphery of the expanded section, with the elastic member mounted around the body portion of the rod and received in the expanded section of the gripping member, and with two opposite ends of the elastic member respectively biased against the first contact surface of the convex portion of the rod and the second contact surface of the gripping member of the sleeve assembly.

4. The tool extension bar as claimed in claim 3, wherein the sleeve member includes a first end adapted for connecting to the tool member, a second end spaced from the first end of the sleeve member along the axis and connected to the first end of the gripping member, and a coupling hole extending between the first and second ends of the sleeve member to mount around the first end of the rod.

5. The tool extension bar as claimed in claim 4, wherein the coupling hole of the sleeve member is connected and in communication with the through hole of the gripping member, with the coupling hole including a larger section, a smaller section, and a middle section arranged between the larger and smaller sections along the axis, with the larger section having a circular cross section perpendicular to the axis and corresponding to a circular cross section of the body portion of the rod, and with the smaller section having a circular cross section perpendicular to the axis and corresponding to a circular cross section of the first end of the rod.

6. The tool extension bar as claimed in claim 5, wherein the middle section has a rectangular cross section perpendicular to the axis and corresponding to a rectangular cross section of the shoulder portion of the rod to increase the joint strength between the rod and the sleeve assembly to cause the rod to be adapted to connect to and be driven by a high torque power tool.

7. The tool extension bar as claimed in claim 6, wherein the convex portion has an outer diameter less than an outer diameter of the second end of the rod, with the outer diameter of the convex portion greater than a width of the shoulder portion and an outer diameter of the body portion of the rod.

8. The tool extension bar as claimed in claim 4, wherein an annular engaging portion is formed at the first end of the gripping member, with the annular engaging portion extending along the axis toward the second end of the sleeve member, with an annular engaging recess formed at the second end of the sleeve member and engaged with the engaging portion of the gripping member to cause the gripping member and the sleeve member to be rotatably connected with each other.

9. The tool extension bar as claimed in claim 4, wherein the first end of the sleeve member has a rectangular cross section perpendicular to the axis, with the second end of the sleeve member having a circular cross section perpendicular to the axis.

10. The tool extension bar as claimed in claim 1, wherein two opposite ends of the shoulder portion along the axis is defined with a first length, with two opposite ends of the body portion along the axis defined with a second length being at least three times as great as the first length.

11. The tool extension bar as claimed in claim 1, wherein the elastic member is a spring.

12. The tool extension bar as claimed in claim 1, wherein the engaging member is a ball.

* * * * *